US007147979B2

(12) United States Patent
Kidokoro

(10) Patent No.: US 7,147,979 B2
(45) Date of Patent: Dec. 12, 2006

(54) TONER FOR DEVELOPING ELECTROSTATIC IMAGE

(75) Inventor: Hiroto Kidokoro, Tokyo (JP)

(73) Assignee: Zeon Corporation, Tokyo (JP)

( * ) Notice: Subject to any disclaimer, the term of this patent is extended or adjusted under 35 U.S.C. 154(b) by 216 days.

(21) Appl. No.: 10/767,731

(22) Filed: Jan. 30, 2004

(65) Prior Publication Data

US 2004/0185363 A1 Sep. 23, 2004

(30) Foreign Application Priority Data

Feb. 3, 2003 (JP) ..... 2003-025741
Jun. 30, 2003 (JP) ..... 2003-187615

(51) Int. Cl.
*G03G 9/08* (2006.01)

(52) U.S. Cl. ..... 430/108.21; 430/109.4; 430/110.4; 430/111.4

(58) Field of Classification Search ..... 430/108.21, 430/109.2, 109.3, 109.4, 110.1, 110.2, 110.3, 430/110.4, 111.4
See application file for complete search history.

(56) References Cited

U.S. PATENT DOCUMENTS 6,436,599 B1 * 8/2002 Matsuoka et al. ..... 430/137.19
6,596,453 B1 * 7/2003 Fujino et al. ..... 430/137.17
2003/0027074 A1 * 2/2003 Emoto et al. ..... 430/124

FOREIGN PATENT DOCUMENTS

| | | |
|---|---|---|
| JP | 53-17736 | 2/1978 |
| JP | 5-197193 | 8/1993 |
| JP | 2000-56508 | 2/2000 |
| JP | 2002-108012 | 4/2002 |

* cited by examiner

*Primary Examiner*—John L Goodrow
(74) *Attorney, Agent, or Firm*—Armstrong, Kratz, Quintos, Hanson & Brooks, LLP.

(57) ABSTRACT

A toner for developing an electrostatic image, comprising, a binder resin, a colorant, a charge control agent, and a parting agent, and wherein: a volume average particle diameter (Dv) of toner particles is 3 to 10 μm; a ratio (Dv/Dp) of Dv to a number average particle diameter (Dp) is 1 to 1.3; an average circle degree is 0.93 to 0.995; and location parameter of island-shaped separate phase is 25 number % or more, wherein the location parameter is the percentage of such sectional photo image of toner particles where a maximum diameter of island-shaped separate phase is 1 μm or more and an outermost portion of said island-shaped separate phase is present at the depth of 0.01 to 0.15 time of the particle diameter of each toner particle under the surface.

18 Claims, 1 Drawing Sheet

TONER FOR DEVELOPING ELECTROSTATIC IMAGE

TECHNICAL FIELD

The present invention relates to a toner for developing an electrostatic image and, more particularly, to a toner for developing an electrostatic image, the toner having satisfactory anti-offset characteristics and high shelf stability.

RELATED ART

Electrophotography is a process in which an electrostatic latent image formed on a photoconductor is developed with an electrostatic latent image developing toner comprising colored particles and an external additive, and, if necessary, a charged toner image is transferred to a recording medium, such as paper or an OHP sheet, and then the transferred toner image is fixed to obtain a printing. There are various conventional methods for development using a toner or for fixing of a toner image, and methods suitable for the respective image forming processes have been employed.

Currently, a thermal fixing process using heat is a predominant method of fixing a toner image. As the thermal fixing process, heat roller fixing is employed in most machines, because of a high thermal efficiency, adaptability to a high speed, and high safety. In the thermal fixing process, however, a heat roll contacts directly with a fused toner image, and the process is thus defective because it is difficult to avoid a so-called offset phenomenon, where the toner adheres to the heat roll and stains a subsequent image, or a so-called wrap-up phenomenon, where, in a more serious event, the recording medium with the fixed image is wrapped around the heat roll. To reduce the adhesion of the toner to the heat roll, it is effective to incorporate a wax or oil with a low aggregation energy into toner particles, which wax or oil fluidifies at a low temperature and does not dissolve into a toner binder resin.

Energy required for fusion of the toner can be decreased by increasing the content of a component melting at a low temperature. However, the presence of such a component on the surface of the toner particles results in the drawback that the flowability of the toner decreases to lower its developing performance or deteriorate its shelf stability.

It has been common practice to produce a toner having a desired particle diameter by pulverization method, namely, by melting and mixing a thermoplastic resin with a colorant to disperse the colorant uniformly, then pulverizing the dispersion finely, and classifying the resulting particles according to the desired particle diameter. This pulverization method is relatively stable as an art, and administration of respective materials and control of respective steps are relatively easy. However, the contents of the toner exist at the surface of the toner particles, which surface is formed by pulverization. Thus, the above-mentioned component for lowering melting point and the component for parting exist at the surface, and there is a problem of adversely affecting image formation.

To solve such a problem, a toner manufacturing method, so-called polymerization method, has been suggested. For example, Japanese Patent Application Laid-Open No. 1978-17736 discloses a method for producing a toner by suspension polymerization, the method comprising: dispersing a pigment in a monomer; treating the pigment-containing monomer in an aqueous medium to form monomer droplets of the size of the toner particles in a suspension; stirring this monomer-containing suspension during the period of polymerization; treating the resulting particles after polymerization to decrease their moisture sensitivity; and then recovering and collecting the toner particles.

If a large amount of a wax melting at a low temperature is contained in the system, the polymerization toner obtained by the above-described manufacturing method can provide a high quality image in an ordinary environment, however, a problem arises that antiblocking properties decline and developing properties lower remarkably, while the toner is stored in a high temperature environment.

Japanese Patent Application Laid-Open No. 1993-197193 discloses a toner for developing an electrostatic image, the toner containing at least two components, (A) a high softening point resin and (B) a low softening point substance, and having a structure separated into an phase A and a phase B, and wherein the phase B does not exist in a region close to the surface ranging from the surface of the toner particles up to a depth of 0.15 time of the toner particle diameter, and the total content of organic solvents and polymerizable monomers in the toner particles is 1,000 ppm or less. This publication discloses that the toner for developing the electrostatic image has an excellent fixability at low temperature and does not require application of a parting agent to a fixing device, and that the toner has an internal structure where there are two functionally separated portion, a superficial portion (phase A) and a central portion (phase B) to have enhanced antiblocking properties. To obtain the parting effect as disclosed in the publication, however, the content of the substance with low softening point in the toner has to be rendered high. As a result, the quality of the resulting image is adversely affected.

Japanese Patent Application Laid-Open No. 2000-56508 discloses a polymerization toner having a core-shell structure produced by suspension polymerization, wherein a parting agent is contained with a number average particle diameter in the range of 0.02 to 3 μm in a section of the toner. This publication discloses that the toner further having a thin shell structure provided on the outside of the toner particles for improving shelf stability has a high transferability and can provide high quality image. This toner fulfills both improved shelf stability and a high image quality. However, a toner further improved in hot offset properties is desired. A further improvement in shelf stability is also desired.

Japanese Patent Application Laid-Open No. 2002-108012 discloses a process for producing a negatively charged toner, which comprises the step of mixing a negative charge control resin with a colorant to obtain a negative charge control resin composition. The toner disclosed in this publication has stable charging properties and an excellent transferability, and provides images in clear color tones. However, a toner further improved in anti-offset properties and shelf stability is desired.

DISCLOSURE OF THE INVENTION

It is an object of the present invention, therefore, to provide a toner for developing an electrostatic image, the toner having improved hot offset properties and improved shelf stability.

The inventor of the present invention carried out an in-depth study to accomplish the object. As a result, he has found that this object can be accomplished by: using a toner comprising, at least, a binder resin, a colorant, a charge control agent, and a parting agent; controlling the volume average particle diameter, the ratio (Dv/Dp) of the volume average particle diameter (Dv) and the number average particle diameter (Dp), and the average circle degree of toner particles into specific ranges; and further controlling location parameter of island-shaped separate phase of the toner particles into a specific range, wherein the lacation parameter is the percentage of toner particles, in which an island-shaped separate phase is present in a specific depth from the surface of each toner particle among the toner particles having the island-shaped separate phase.

The present invention has been accomplished based on the above finding. According to the present invention, there is provided a toner for developing an electrostatic image, said toner containing toner particles comprising, at least, a binder resin, a colorant, a charge control agent, and a parting agent, and wherein: a volume average particle diameter (Dv) of said toner particles is 3 to 10 μm; a ratio (Dv/Dp) of said volume average particle diameter to a number average particle diameter (Dp) of said toner particles is 1 to 1.3; an average circle degree of said toner particles is 0.93 to 0.995; and location parameter of island-shaped separate phase is 25 number % or more, wherein the location parameter is the percentage of such sectional photo image of toner particles where a maximum diameter of island-shaped separate phase is 1 μm or more and an outermost portion of said island-shaped separate phase is present at the depth of 0.01 to 0.15 time of the particle diameter of each toner particle under the surface of said toner particle, among sectional photo images of said toner particles having an island-shaped separate phase and a particle diameter in the range of 0.6 to 1.2 time of said volume average particle diameter, when said toner particles are embedded in a resin, a thin slice of an embedded product is cut off, sectional images of said toner particles in said thin slice are photographed with an electron microscope, and in resulting photographs sectional photo images of said toner particles are observed in resulting photographs.

By using the above-mentioned toner for developing an electrostatic image, anti-offset properties and shelf stability can be improved.

BRIEF DESCRIPTION OF THE DRAWING

FIG. shows a sample of a schematic sectional view of a toner particle constituting a toner for developing an electrostatic image according to the present invention.

10: Toner particle

Figure 1:
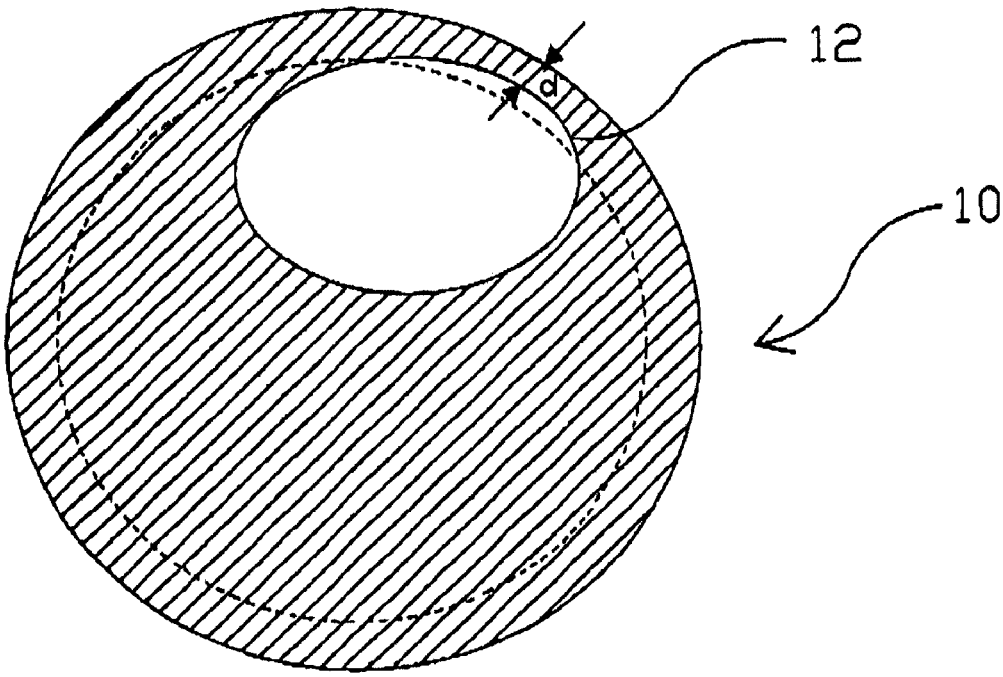

12: Island-shaped separate phase d: Depth of the outermost portion of the island-shaped separate phase

BEST MODE FOR CARRYING OUT THE INVENTION

A toner for developing an electrostatic image according to the present invention is described in detail below.

The toner for developing an electrostatic image according to the present invention contains toner particles comprising, at least, a binder resin, a colorant, a charge control agent and a parting agent. The toner particles, if desired, may also further comprise a magnetic material, etc.

As examples of the binder resin, resins which have been conventionally and widely used for toners can be mentioned, such as polystyrenes, styrene-butyl acrylate copolymers, polyester resins, and epoxy resins.

As the colorant, there can be mentioned any pigments and dyes, including carbon black, titanium black, magnetic powder, oil black, and titanium white. Carbon black having a primary particle diameter of 20 to 40 nm is preferably used as a black colorant. The particle diameter within this range is preferred, because such carbon black can be uniformly dispersed in the toner and fog in printed image developed using the resulting toner decreases.

For a full color toner, a yellow colorant, a magenta colorant and a cyan colorant are generally used.

As the yellow colorant, there can be mentioned compounds such as azo pigments, and condensed polycyclic pigments. Specific examples of the yellow colorant include pigments such as C.I. Pigment Yellow 3, 12, 13, 14, 15, 17, 62, 65, 73, 74, 83, 90, 93, 97, 120, 138, 155, 180, 181, 185 and 186.

As the magenta colorant, there can be mentioned compounds such as azo pigments, and condensed polycyclic pigments. Specific examples of the magenta colorant include pigments such as C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209, 251, and C.I. Pigment Violet 19.

As the cyan colorant, there can be mentioned cupper phthalocyanine compounds and their derivatives, anthraquinone compounds and the like. Specific examples of the cyan colorant include pigments such as C.I. Pigment Blue 2, 3,6, 15, 15:1, 15:2, 15:3, 15:4, 16, 17, and 60.

Any of these colorants is used, preferably, in the amount of 1 to 10 parts by weight per 100 parts by weight of the binder resin.

As examples of the parting agent, there can be mentioned: polyolefin waxes such as low molecular weight polyethylene, low molecular weight polypropylene, and low molecular weight polybutylene; natural plant waxes such as candelilla, carnauba, rice, Japan wax, and jojoba; petroleum waxes such as paraffin, microcrystalline and petrolatum, as well as waxes modified therefrom; synthetic waxes such as Fischer-Tropsch wax; and polyfunctional ester compounds such as pentaerythritol tetramyristate, pentaerythritol tetrapalmitate, and dipentaerythritol hexamyristate. These parting agents may be used alone or in a combination thereof.

Among these parting agents, synthetic waxes and polyfunctional ester compounds are preferred. Polyfunctional ester compounds are more preferred, which show an endothermic peak temperature within a range of, preferably 30° C. to 150° C., more preferably 40° C. to 100° C., and most preferably 50° C. to 80° C., measured with a DSC curve by means of a differential scanning calorimeter (DSC) at rising temperature, because a toner excellent in a balance between fixing-peeling property during fixing is obtained. Of these, a polyfunctional ester compound, which has a molecular weight of 1,000 or more, is soluble in styrene at 25° C. in the proportion of 5 parts by weight or more based on 100 parts by weight of styrene, and has an acid value of 10 mg KOH/g or less, is even more preferred, because it exhibits a distinguished effect in lowering the fixing temperature. Dipentaerythritol hexamyristate is particularly preferred as the polyfunctional ester compound. The above-mentioned endothermic peak temperatures refer to values measured in accordance with ASTM D3418-82.

The amount of the parting agent is generally 3 to 20 parts by weight, preferably 5 to 15 parts by weight, per 100 parts by weight of the binder resin.

The toner for developing the electrostatic image according to the present invention comprises a charge control agent. As the charge control agent, conventional charge control agents used for toners can be used without limitation. Of the charge control agents, charge control resins are preferable, because charge control resins have high compatibility with binder resins, are colorless, and a toner with charge stability, even in a high speed continuous color printing, can be obtained. As the charge control resin, there can be mentioned quaternary ammonium (salt) group-containing copolymers produced in accordance with the descriptions of Japanese Patent Application Laid-Open Nos. 1988-60458, 1991-175456, 1991-243954, and 1999-15192, and sulfonic acid (salt) group-containing copolymers produced in accordance with the descriptions of Japanese Patent Application Laid-Open Nos. 1989-217464 and 1991-15858.

The amount of the monomer unit having the quaternary ammonium (salt) group or the sulfonic acid (salt) group contained in these copolymers is preferably 0.5 to 15% by weight, more preferably 1 to 10% by weight. If the content of the monomer unit is within this range, the charge level of the toner is easy to control, and the generation of fog in printed image developed using the toner can be minimized.

Preferred as the charge control resin is that having a weight average molecular weight of 2,000 to 50,000, more preferably 4,000 to 40,000, most preferably 6,000 to 35,000. If the weight average molecular weight of the charge control resin is less than 2,000, the resulting toner may cause hot offset. If the weight average molecular weight exceeds 50,000, by contrast, fixability of the toner may become poor.

The glass transition temperature of the charge control resin is preferably 40 to 80° C., more preferably 45 to 75° C., most preferably 45 to 70° C. If the glass transition temperature of the charge control resin is lower than 40° C., the shelf stability of the resulting toner may become deteriorated. If the glass transition temperature exceeds 80° C., fixability of the resulting toner may lower.

The amount of the charge control agent used is generally 0.01 to 30 parts by weight, preferably 0.3 to 25 parts by weight, per 100 parts by weight of the binder resin.

The toner particle maybe a so-called core-shell structure (also called "capsule type") particle, in which the binder resin for an inner layer of the particle (core layer) is different from the binder resin for an outer layer of the particle (shell layer). The core-shell structure is preferred, because the structure can provide a favorable balance between lowering of the fixing temperature and prevention of aggregation of the toner during storage by covering the low softening point substance as the inner layer (core layer) with a substance having a higher softening point (shell layer).

Generally, the core layer of the core-shell structure particle is composed of the aforementioned binder resin, colorant, charge control agent, and parting agent, while the shell layer is composed of the binder resin alone.

The proportion by weight of the core layer to the shell layer of the core-shell structure particle is not particularly limited, but is generally in the range (core layer/shell layer) of from 80/20 to 99.9/0.1. By using the shell layer in this proportion, good shelf stability and good low temperature fixability of the toner can be fulfilled at the same time.

The average thickness of the shell layer of the core-shell structure particle may be generally 0.001 to 0.1 μm, preferably 0.003 to 0.08 μm, and more preferably 0.005 to 0.05 μm. If the thickness is too large, fixability of the resulting toner may decline. If it is too small, shelf stability of the resulting toner may decline. The core particle constituting the core-shell structure toner particle does not necessarily have all of its surface covered with the shell layer. The surface of the core particle may partly be covered with the shell layer.

The diameter of the core particle and the thickness of the shell layer of the core-shell structure particle can be measured by directly measuring the size and shell thickness of particles which are chosen randomly from photographs taken with an electron microscope, if possible. When it is difficult to observe both of the core and shell layer by an electron microscope, they can be calculated based on the diameter of the core particle and the amount of the monomer used for forming the shell layer at the time of producing the toner.

The toner particles constituting the toner for developing the electrostatic image according to the present invention have a volume average particle diameter (Dv) of 3 to 10 μm, preferably 5 to 8 μm. If Dv is less than 3 μm, flowability of the toner decreases. As a result, fog may be generated in printed image, the toner may partly remain untransferred upon transfer, or cleaning properties may deteriorate. If Dv exceeds 10 μm, fine line reproduction may decline.

The toner particles constituting the toner for developing the electrostatic image according to the present invention have the ratio of the volume average particle diameter (Dv) to the number average particle diameter (Dp), i.e. the ratio (Dv/Dp) , of 1.0 to 1.3, preferably 1.0 to 1.2. If Dv/Dp exceeds 1.3, fog occur in printed image.

The volume average particle diameter and the number average particle diameter of the toner particles can be measured, for example, by use of Multisizer (manufactured by Beckman Coulter Inc.).

The toner particles constituting the toner for developing the electrostatic image according to the present invention have average circle degree of 0.93 to 0.995, preferably 0.95 to 0.995, more preferably 0.96 to 0.995. If the average circle degree is less than 0.93, fine line reproduction is poor in any of an L/L environment (temperature: 10° C., humidity: 20%), an N/N environment (temperature: 23° C., humidity: 50%), or an H/H environment (temperature: 35° C., humidity: 80%). The average circle degree can be controlled into these ranges relatively easily by producing the toner by phase-transfer emulsion process, solution suspension process, or polymerization process.

In the present invention, the circle degree of a particle is defined as a circuit length of the circle which has the same area with the projection of the particle, divided by perimeter length of the projection of the particle. The average circle degree is adopted to represent shapes of the particle quantitatively and simply, and it is an index which shows a degree of the roughness of the particles. If the toner particles are perfectly spherical, the average circle degree equals to 1. The more complicated the surface of the colored polymer particles are, the smaller the average circle degree becomes. The circle degree ($C_i$) of each particle is obtained with measured lengths and the next following equation for n particles, which particles have particle diameters not smaller than 1 μm. Then the average circle degree (Ca) is calculated using the second next following formula. $C_i$=circuit length of the circle having the same area with the projection of each particle/perimeter length of the projection of each particle $$\text{average circle degree} = \left(\sum_{i=1}^{n}(Ci \times fi)\right) \Big/ \sum_{i=1}^{n}(fi)$$

In the above formula, $f_i$ denotes frequency of particle having circle degree $C_i$.

The Circle degree and the average circle degree may be measured with flow type particle projection image analyzers, such as FPIA-1000 or FPIA-2000, products of Sysmex Corporation.

The toner for developing the electrostatic image according to the present invention has location parameter of island-shaped separate phase of 25 number % or more, preferably, 35 number % or more, and more preferably 45 number % or more. If this location parameter of island-shaped separate phase is less than 25 number %, fixability declines.

The location parameter of island-shaped separate phase is defined as the percentage of such sectional photo image of toner particles where a maximum diameter of island-shaped separate phase is 1 μm or more and an outermost portion of said island-shaped separate phase is present at the depth of 0.01 to 0.15 time of the particle diameter of each toner particle under the surface of said toner particle, among sectional photo images of said toner particles having an island-shaped separate phase and a particle diameter in the range of 0.6 to 1.2 time of said volume average particle diameter, when said toner particles are embedded in a resin, a thin slice of an embedded product is cut off, sectional images of said toner particles in said thin slice are photographed with an electron microscope, and in resulting photographs sectional photo images of said toner particles are observed.

The position of existence of the island-shaped separate phase is explained below with reference to the appended drawing. FIGURE is a sample of a schematic sectional view of a toner particle constituting the toner for developing the electrostatic image according to the present invention. A dashed line in FIGURE represents the depth which is 0.15 time of the particle diameter of a toner particle 10. In FIGURE, the depth which is 0.01 time of the particle diameter of the toner particle 10 is not shown, because the site at this depth is almost contiguous to the surface of the toner particle 10. As shown in FIGURE, depth (d) of the outermost portion of an island-shaped separate phase 12 is in the range of 0.01 to 0.15 time of the particle diameter of the toner particle under the surface of the toner particle.

The toner for developing the electrostatic image according to the present invention has a tetrahydrofuran-extractable component content of generally 10 to 80% by weight, preferably 10 to 70% by weight. If the tetrahydrofuran-extractable component content is less than 10% by weight, fixability of the toner may decline. If this content exceeds 80% by weight, on the other hand, fog may occur in printed image or hot offset may occur. The tetrahydrofuran-extractable component content can be measured by a method to be described later.

The toner for developing the electrostatic image according to the present invention has an acid value of, preferably, 5 mg KOH/g or less, and more preferably, 3 mg KOH/g or less. If this acid value exceeds 5 mg KOH/g, fog may occur.

The toner for developing the electrostatic image according to the present invention has an amine value of, preferably, 3.25 mg HCl/g or less, and more preferably, 3 mg HCl/g or less. If this amine value exceeds 3.25 mg HCl/g, fog may occur.

The acid value and the amine value of the toner for developing the electrostatic image can be measured by methods to be described later.

The toner for developing the electrostatic image according to the present invention can be used, as it is, for development in electrophotography. Generally, however, it is preferrable that the toner is used after fine particles having a smaller particle diameter than that of the toner particles (the fine particles will be referred to hereinafter as an external additive) are adhered to or buried into the surfaces of the toner particles, in order to adjust the charging properties, flowability and shelf stability of the toner.

Examples of the external additive are inorganic particles and organic resin particles which are generally used for improving flowability and charging properties. These particles, added as the external additives, have a smaller average particle diameter than that of the toner particles. Specific examples of the inorganic particles include silica, aluminum oxide, titanium oxide, zinc oxide, and tin oxide. Specific examples of the organic resin particles include methacrylic ester polymer particles, acrylic ester polymer particles, styrene-methacrylic ester copolymer particles, styrene-acrylic ester copolymer particles, core-shell structure particles having a core formed of a styrene polymer and a shell formed of a methacrylic ester polymer. Of these particles, silica particles and titanium oxide particles are preferred. These particles having their surface hydrophobicitizing-treated are more preferred, and hydrophobicitizing-treated silica particles are even more preferred. The amount of the external additive is not particularly limited, but is generally 0.1 to 6 parts by weight per 100 parts by weight of the toner particles.

The toner for developing the electrostatic image according to the present invention is preferably produced by a polymerization method, although the method of production is not limited, as long as it can provide a toner having the properties within the above-mentioned preferred ranges.

The followings are detailed description about the method of producing toner particles constituting the toner for developing the electrostatic image by the polymerization method.

Toner particles constituting the toner for developing the electrostatic image according to the present invention may be produced, for example, by: dispersing a polymerizable monomer composition containing a polymerizable monomer, a colorant, a parting agent, and a charge control resin in an aqueous dispersion medium containing a dispersion stabilizer to form droplets; then heating the aqueous dispersion medium to a desired polymerization temperature to initiate polymerization; and then polymerizing the monomer in the presence of oxygen. Preferably, the toner can be produced by performing polymerization in a nitrogen atmosphere during the period from the start of heating until arrival to the desired polymerization temperature, and performing polymerization in the presence of oxygen after arrival to the desired polymerization temperature. The presence of oxygen herein refers to a condition where oxygen, even in a small amount, is present within the polymerization system. The method of achieving the presence of oxygen within the polymerization system may be to introduce oxygen or air into the liquid phase or gaseous phase of the polymerization system. Since oxygen requires care in handling, it is preferable to use air. The oxygen concentration within the polymerization system may be about 20%, comparable to the proportion in the air.

The temperature of the aqueous dispersion medium before the start of heating is generally 10 to 40° C., and is preferably controlled into the range of 20 to 30° C. If this temperature is too high, a polymerization reaction may start partially within the system. If this temperature is too low, by contrast, the fluidity of the system may decline to impede the formation of droplets when the droplets are formed by stirring.

A preferable method for raising the temperature of the aqueous dispersion medium to the desired polymerization temperature is to: raise the temperature at the rate of 25 to 80° C./hour, until it reaches a temperature 5° C. lower than the desired polymerization temperature; and raise the temperature at the rate of 3 to 10° C./hour in the temperature region from it reaches the temperature 5° C. lower than the desired polymerization temperature until it reaches the desired polymerization temperature.

If the rate of rising temperature up to the temperature 5° C. lower than the desired polymerization temperature is smaller than 25°/hour, the island-shaped separate phase may be formed at the center of the toner particle. This means that the location parameter of island-shaped separate phase is small, and as a result, fixability of the toner may decline. If the rate is greater than 80° C./hour, the toner tends to occur hot offset, and furthermore, the polymerization reaction speed is so high that the reaction is difficult to control and dangerous.

If the rate of rising temperature in the temperature region from the temperature is 5° C. lower than the desired polymerization temperature until it reaches the desired polymerization temperature is smaller than 3° C./hour, the polymerization time may lengthen. If this rate is larger than 10° C./hour, the toner tends to occur hot offset.

There is no particular limitation imposed on the method of controlling the rate of rising temperature of the aqueous dispersion medium in the above-mentioned manner. However, as an example of the method there can be mentioned: measuring the temperature of the aqueous dispersion medium, and controlling the temperature of the jacket around the reactor by a controlling method (to be described later) according to the measured temperature to controll the temperature of the aqueous dispersion medium.

The method of controlling the temperature of the aqueous dispersion medium may be an ordinary controlling method. Specific examples of such controlling method include feedback control and feed forward control, using a control algorithm, such as P control, PI control, PID control, optimal control, fuzzy control or cascade control.

In the present invention, to obtain the polymerizable monomer composition, it is preferable to mix the colorant and the charge control resin to obtain a charge control resin composition, and add the charge control resin composition in advance, together with the parting agent, to the polymerizable monomer, followed by mixing these components. The amount of the colorant is generally 10 to 200 parts by weight, preferably 20 to 150 parts by weight, per 100 parts by weight of the charge control resin.

To prepare the charge control resin composition, the use of an organic solvent is preferable. By using the organic solvent, the charge control resin softens and is easily mixable with the pigment.

The amount of the organic solvent is generally 0 to 100 parts by weight, preferably 5 to 80 parts by weight, and more preferably 10 to 60 parts by weight, per 100 parts by weight of the charge control resin. Within this range, an excellent balance between dispersibility and processability of the polymerizable monomer composition is obtained. The organic solvent may be added either at one time or dividedly upon observing the condition of the mixture.

Mixing of the charge control resin and the colorant may be performed using equipment such as a roll, a kneader, a single screw extruder, a twin screw extruder, a Banbury mixer, a Buss co-kneader, and the like. When an organic solvent is used, it is preferred to use the mixing equipment in a closed system with a structure which prevents leakage of the organic solvent to the outside. Moreover, it is preferable to use the mixing equipment furnishing a torque meter, because the torque meter enables to monitor and control the dispersion degree.

As a polymerizable monomer, a raw material of the binder resin, there can be mentioned, for instance, a monovinyl monomer, a cross-linkable monomer and a macromonomer. These polymerizable monomers become the binder resin component after polymerization. Specific examples of the monovinyl monomers include; aromatic vinyl monomers such as styrene, vinyltoluene, and α-methylstyrene; acrylic acid and its derivatives such as methyl acrylate, ethyl acrylate, propyl acrylate, butyl acrylate, 2-ethylhexyl acrylate, cyclohyxl acrylate, isobonyl acrylate, dimethylaminoethyl acrylate and acrylamine; methacrylic acid and its derivatives such as methyl methacrylate, ethyl methacrylate, propyl methacrylate, butyl methacrylate, 2-ethylhexyl methacrylate, cyclohexyl methacrylate, isobonyl methacrylate, dimethylaminoethyl methacrylate and methacrylamide;and mono olefin monomers such as ethylene, propylene and butylenes; and the like. The monovinyl monomers may be used alone or in a combination thereof. Among the monovinyl monomers as mentioned above, it is preferable to use aromatic vinyl monomers alone, or to use aromatic vinyl monomers in a combination with acrylic acid derivatives or methacrylic acid derivatives.

The use of the crosslinkable monomer in a combination with the monovinyl monomer effectively improves hot offset resistance of the resulting toner. The crosslinkable monomer is a monomer having two or more vinyl groups. As specific examples of the crosslinkable monomer, there can be mentioned divinylbenzene, divinylnaphthalene, ethylene glycol dimethacrylate, pentaerythritol triallyl ether, and trimethylolpropane triacrylate. These crosslinkable monomers may be used alone or in a combination thereof. The amount of the crosslinkable monomer used is generally 10 parts by weight or less, preferably 0.1 to 2 parts by weight, per 100 parts by weight of the monovinyl monomer.

It is preferable to use a macromonomer together with the monovinyl monomer, because this use provides a satisfactory balance between shelf stability and fixability at a low temperature. The macromonomer is an oligomer or polymer having a polymerizable carbon-carbon unsaturated double bond at its molecular chain terminal and a number average molecular weight of generally from 1,000 to 30,000.

The macromonomer is preferably the one which gives a polymer, by polymerization alone, having a glass transition temperature higher than that of a polymer obtained by polymerizing the above-mentioned monovinyl monomer alone.

The amount of the macromonomer used is generally 0.01 to 10 parts by weight, preferably 0.03 to 5 parts by weight, more preferably 0.05 to 1 part by weight, per 100 parts by weight of the monovinyl monomer.

As examples of the polymerization initiator, there can be mentioned: persulfates such as potassium persulfate and ammonium persulfate; azo compounds such as 4,4'-azobis-(4-cyanovaleric acid), 2,2'-azobis-(2-methyl-N-(2-hydroxyethyl))propionamide, 2,2'- azobis-(2-amidinopropane) bihydrochloride, 2,2'-azobis-(2,4-dimethyl valeronitrile), and 2,2'-azobis-isobutyronitrile; and peroxides such as di-t-butyl peroxide, benzoyl peroxide, t-butyl peroxy-2-ethylhexanoate, t-hexyl peroxy-2-ethylhexanoate, t-butyl peroxypivalate, di-isopropyl peroxydicarbonate, di-t-butyl peroxyisophthalate, and t-butyl peroxyisobutyrate. Redox initiators, composed of combinations of these polymerization initiators with a reducing agent, may also be used.

The amount of the polymerization initiator used in the polymerization of the polymerizable monomer composition is preferably 0.1 to 20 parts by weight, more preferably 0.3 to 15 parts by weight, and most preferably 0.5 to 10 parts by weight, per 100 parts by weight of the polymerizable monomer. The polymerization initiator may be added to the polymerizable monomer composition in advance or, in some cases, may be added into the aqueous dispersion medium after formation of droplets.

In performing polymerization, a dispersion stabilizer is preferably used in the aqueous medium. As examples of the dispersion stabilizer, there can be mentioned: inorganic salts such as barium sulfate, calcium carbonate, and calcium phosphate; inorganic oxides such as silica, aluminum oxide and titanium oxide; inorganic hydroxides such as aluminum hydroxide, magnesium hydroxide, and ferric hydroxide; water soluble polymers such as polyvinyl alcohol, methyl cellulose, and gelatin; anionic surface active agents, cationic surface active agents, nonionic surface active agents and amphoteric surface active agents. These dispersion stabilizers may be used alone or in a combination thereof.

Among these dispersion stabilizers, the dispersion stabilizer containing a colloid of the slightly water-soluble inorganic hydroxide is particularly preferable because the particle diameter distribution of the resulting polymer particles can be narrowed and the amount of the dispersion stabilizer after rinsing is small, so that bright or sharp images can be reproduced in printed image.

The production process for the dispersion stabilizer containing the colloid of the slightly water-soluble inorganic hydroxide is not particularly limited. However, it is preferable to use a colloid of a slightly water-soluble inorganic hydroxide obtained by adjusting the pH of an aqueous solution of a water-soluble polyvalent inorganic compound to 7 or higher, and especially a colloid of a slightly water-soluble inorganic hydroxide formed by reacting a water-soluble polyvalent inorganic compound with an alkali metal hydroxide.

The amount of the dispersion stabilizer used is preferably 0.1 to 20 parts by weight per 100 parts by weight of the polymerizable monomer. If the amount of the dispersion stabilizer is less than 0.1 part by weight, it is difficult to achieve sufficient polymerization stability, so that the resulting polymer tends to aggregate. On the other hand, if the amount of the dispersion stabilizer used exceeds 20 parts by weight, particle diameters of the toners after polymerization become so small that the resulting toner may be inappropriate for practical use.

A molecular weight modifier is preferably used during polymerization. As examples of the molecular weight modifier, there can be mentioned mercaptans such as t-dodecylmercaptan, n-dodecylmercaptan, n-octylmercaptan, and 2,2,4,6,6-pentamethylheptane-4-thiol. These molecular weight modifiers may be added before the initiation of the polymerization or during the course of the polymerization. The amount of the molecular weight modifier used is preferably 0.01 to 10 parts by weight, more preferably 0.1 to 5 parts by weight, per 100 parts by weight of the polymerizable monomer.

No limitation is imposed on a method for producing the above-described preferred core-shell structure toner particles, and these toner particles can be produced by a publicly known method. For example, a method such as spray-drying method, interfacial reaction method, in-situ polymerization method, or phase separation method maybe named. Concretely, core-shell structure toner particles are obtained by: forming toner particles by pulverization process, polymerization process, association process or phase-transfer emulsion process, and covering the toner particles, as core particles, with a shell layer. Of these methods, the in-situ polymerization method and phase-separation method are preferable because of their efficient productivity.

The method for producing the core-shell structure toner particles using the in-situ polymerization process is described in detail below.

A polymerizable monomer to form a shell (polymerizable monomer for shell) and a polymerization initiator are added to an aqueous dispersion medium including core particles dispersed therein, and the mixture is polymerized to obtain the core-shell structure toner particles.

As specific examples of the process for forming the shell, there can be mentioned: a process in which a polymerizable monomer for shell is added to the above-mentioned reaction system of the polymerization reaction performed to obtain the core particles, and polymerized in-situ continuously; and a process in which core particles obtained in a separate reaction system are provided into the reaction system and a polymerizable monomer for shell is added and then polymerized.

The polymerizable monomer for shell may be provided into the reaction system at one time, or may be provided continuously or dividedly using a pump such as a plunger pump.

As the polymerizable monomer for shell, monomers capable of forming a polymer having a glass transition temperature of higher than 80° C. by polymerization alone, such as styrene, acrylonitrile and methyl methacrylate, may be used alone or in a combination thereof.

When the polymerizable monomer for shell is added to the reaction system, a water-soluble polymerization initiator is preferably added, because this addition makes it easy to obtain the core-shell structure toner particles. It is speculated that when the water-soluble polymerization initiator is added during addition of the polymerizable monomer for shell, the water-soluble polymerization initiator migrates to a zone surrounding the surface of the core particle, the zone where the polymerizable monomer for shell has moved, so that a polymer (shell) is easily formable on the surface of the core particle.

Examples of the water-soluble polymerization initiator include: persulfates such as potassium persulfate, and ammonium persulfate; azo compounds such as 2,2'-azobis-(2-methyl-N-(2-hydroxyethyl)propionamide), and 2,2'-azobis-(2-methyl-N-(1,1'-bis(hydroxymethyl)-2-hydroxyethyl) propionamide. The amount of the water-soluble polymerization initiator is generally 0.1 part to 50 parts by weight, preferably 1 to 30 parts by weight, per 100 parts by weight of the polymerizable monomer for shell.

The temperature during polymerization is preferably 50° C. or higher, more preferably 60 to 95° C. The polymerization reaction time is preferably 1 to 20 hours, more preferably 2 to 10 hours. After completion of the polymerization, a procedure comprising filtration, washing, dehydration and drying is preferably repeated several times, as desired, in accordance with the conventional methods.

An aqueous dispersion of the toner particles obtained by polymerization preferably undergoes the following treatment: if the inorganic compound, such as inorganic hydroxide, is used as the dispersion stabilizer, an acid or an alkali is added to dissolve the dispersion stabilizer into water, following by removing it; if the colloid of slightly water-soluble inorganic hydroxide is used as the dispersion stabilizer, an acid is added to adjust the pH of the aqueous dispersion to 6.5 or less. An inorganic acid, such as sulfuric acid, hydrochloric acid or nitric acid; or an organic acid, such as formic acid or acetic acid; can be used as the acid to be added. Sulfuric acid is particularly preferable, because it has a high efficiency of its removal and its burden on production facilities is light.

There is no limitation on the method of filtering toner particles from the aqueous dispersion medium for dehydration. For example, centrifugal filtration, vacuum filtration or pressurized filtration can be named. Of these methods, centrifugal filtration is preferable.

The toner for developing an electrostatic image according to the present invention is obtained by mixing the toner particles and the external additive and, if desired, other fine particles by means of a high speed stirrer such as a Henschel mixer.

EXAMPLES

The present invention is hereinafter to be described more specifically by the following examples. Such examples, however, are not to be construed as limiting in any way the scope of the present invention. All designations of "part" or "parts" and "%" used in the following examples mean part or parts by weight and wt. % unless expressly noted.

In the examples, the toner for developing an electrostatic image was evaluated by the following tests.

(1) Particle Diameter

The volume average particle diameter (Dv) of toner particles and the particle diameter distribution (Dv/Dp), i.e., the ratio of the volume average particle diameter (Dv) to the number average particle diameter (Dp), were measured by means of a particle diameter measuring device ("Multisizer", manufactured by Beckman Coulter Inc.). The measurement by the Multisizer was conducted under the following conditions:

Aperture diameter: 100 μm;

Medium: Isothone II; and

Number of particles measured: 100,000 particles.

(2) Average Circle Degree

A container was provided with 10 ml of ion-exchanged water in advance, and 0.02 g of a surface active agent (alkylbenzenesulfonic acid) was added as a dispersing agent. Then, 0.02 g of a sample was added, and the mixture was dispersed at power of 60 W for 3 minutes by an ultrasonic dispersing device. The toner concentration at the time of measurement was adjusted to 3,000 to 10,000 toner particles/μL. Circle degrees of 1,000 to 10,000 toner particles having diameters 1 μm or more were measured by a flow type particle projection image analyzer (FPIA-2100, manufactured by Sysmex Corp.). The average circle degree was obtained from the measured values.

(3) Location Parameter of the Island-Shaped Separate Phase

The toner for developing the electrostatic image was dispersed in an epoxy prepolymer and cured, cooled to a temperature of −80° C., and cut with a microtome to prepare a thin slice. The thin slice of the epoxy resin was stained for about 5 minutes in a vapor of an aqueous solution of ruthenium tetroxide having a concentration of 0.5%, and observed by TEM (transmission electron microscope). The concentration of the toner was adjusted so that 5 to 20 sectional photo images of toner particles could be observed in an area of 28×35 μm (magnification: ×2,000 to ×6,000). The photo image may have been that of the particle elliptically deformed in the direction of cutting when the particle was cut with the microtome. In this case, the photo image data were taken into a personal computer through a scanner, and distortion in the direction of cutting was decreased in the direction of distortion to correct the entire image.

In the photo image in the above area of 28×35 μm, the sectional photo images of the toner particles, which failed to show the entire image of the toner section, and those whose particle diameters deviated from the range of 0.6 to 1.2 time of the volume average particle diameter, were excluded from counting.

Only the particles having the island-shaped separate phase with a maximum diameter of 1 μm or more were included in counting.

In each of the sectional photo images showing the island-shaped separate phases, the shortest distance (depth) , d, from the outermost portion of the island-shaped separate phase to the peripheral edge (surface line) of the toner particle was measured (see FIGURE)

When d fell in the range of from 0.01 to 0.15 time of the particle diameter of the toner particle, it was judged that the outermost portion of the island-shaped separate phase was existent at a depth of 0.01 to 0.15 time the particle diameter of the toner particle under the surface of the toner particle.

The particles, whose section showed two or more island-shaped separate phase, were counted as follows: if any one of the island-shaped separate phases had an outermost portion which existed at a depth of 0.01 to 0.15 time of the particle diameter of each toner particle under the surface of the toner particle, the outermost portion of the island-shaped separate phase was regarded as existing at a depth of 0.01 to 0.15 time of the particle diameter of the toner particle.

Location parameter of island-shaped separate phase is the percentage of such sectional photo images of toner particles judged true for such a requirement.

(4) Tetrahydrofuran-Extractable Component Content

The toner (0.8 to 1.0 g) was accurately weighed and put into an extraction thimble (cylindrical filter paper; No. 86R, manufactured by Toyo Roshi Ltd.) and subjected to extraction for 6 hours using 100 ml of tetrahydrofuran (THF) as an extraction solvent charged into a Soxhlet extractor. After completion of the extraction, THF was removed by evaporation to obtain nonvolatile component. The nonvolatile component was vacuum dried for 1 hour at a temperature of 50° C., and then weighed. The weighed value was divided by the weighed value of the initially weighed toner to calculate the THF-extractable component content.

(5) Amine Value of the Toner for Developing The Electrostatic Image

The toner for developing the electrostatic image (1 g) was accurately weighed and dissolved in 100 ml of THF, and suction filtered through a filter paper to remove insoluble components. Then, the resulting solution was further passed through a filter with a pore size of 0.45 μm. The filtrate was titrated with a 0.01N methyl isobutyl ketone (MIBK) solution of perchloric acid. Based on the amount of the perchloric acid MIBK solution required for neutralization, the amine value (mg HCl/g) of the toner for developing the electrostatic image was determined. An automatic potentiometric titration device AT-500N (manufactured by Kyoto Electronics Manufacturing Co., Ltd.) was used for titration, and #100-C172 (manufactured by same) was used as an electrode. The 0.01N MIBK perchloric acid solution used was prepared by diluting a 0.1N dioxane solution of perchloric acid (manufactured by Kishida Chemicals, for non-aqueous titration use) 10 times with MIBK. The measurement was made in a nitrogen atmosphere to avoid the influence of moisture and carbon dioxide in air.

(6) Acid Value of the Toner for Developing an Electrostatic Image

The toner for developing an electrostatic image (1 g) was accurately weighed and dissolved in 100 ml of THF, and suction filtered through a filter paper to remove insoluble components. Then, the resulting filtrate was further passed through a filter with a pore size of 0.45 μm. To the filtrate, 20 ml of 0.01N MIBK solution of tetrabutylammonium hydroxide (TBAH) was added, and then the mixture was titrated with a 0.01N MIBK solution of perchloric acid. Based on the amount of the perchloric acid solution required for neutralization, the acid value (mg KOH/g) of the toner for developing the electrostatic image was determined. The 0.01N MIBK solution of TBAH used was prepared by diluting a 30% methanol solution (manufactured by TOKYO KASEI KOGYO, for nonaqueous titration use) with MIBK. The 0.01N MIBK solution of perchloric acid and the device for titration used were the same as used in test (5), and the titration procedure was performed in the same manner.

(7) The Toner Fixing Temperature

A fixing test was conducted using a commercially available 600 dpi nonmagnetic one-component development type printer (14-sheet/min machine) modified such that the temperature of its fixing roll portion would be variable. The fixing test was performed by varying the temperature of the fixing roll of the modified printer by 5° C. at a time, and measuring the fixing rate of the developer at each temperatures to determine the relationship between the temperature and the fixing rate. The fixing rate was calculated from the ratio of image density after a tape peeling treatment to that before the treatment in a black printing area in a test sheet printed by the modified printer. That is, the fixing rate was calculated from the following equation:

$$\text{Fixing rate (\%)}=(ID_{After}/ID_{Before})\times 100$$

where $ID_{Before}$ represents the image density before tape peeling, and $ID_{After}$ represents the image density after tape peeling.

The tape peeling treatment means a series of steps consisting: applying an adhesive tape (Scotch Mending Tape 810-3-18, manufactured by Sumitomo 3M Limited) to a portion of the test sheet to be measured, pressing the adhesive tape by a 500 g steel roller for adhesion, and then peeling the adhesive tape at a constant speed in a direction along the sheet. The image density was measured by use of a Macbeth's reflection type image density measuring device. The toner fixing temperature denotes the temperature of the fixing roll at which the fixing rate became 80% in the fixing test.

(8) Hot Offset Resistance

As in the measurement of the toner fixing temperature in test (7), the temperature of the fixing roll was varied by 5° C. at a time, and printing was done at each temperature. Hot offset resistance denotes the temperature at which the toner becomes to remain on the fixing roll to generate soil.

(9) Flowability

Three sieves with aperture sizes of 150 μm, 75 μm and 45 μm, respectively, were stacked, in this order with the 150 μm sieve laid at the top. A sample (toner, 4 g) was accurately weighed and placed on the sieve at the top. Then, the three stacked sieves were vibrated for 15 seconds with vibration intensity of 4 with the use of a powder measuring device (trade name: Powder Tester, manufactured by Hosokawa Micron Ltd.), and then the weight of the toner remaining on each sieve was measured. The measured values were substituted into the following equations for calculation to determine values of flowability. The measurement was made three times for one sample, and the average of the measured values was obtained.

Equations for Calculation:

$a$=(weight (g) of the toner remaining on the sieve of the aperture size 150 μm)/4 (g)×100;

$b$=(weight (g) of the toner remaining on the sieve of the aperture size 75 μm)/4 (g)×100×0.6;

$c$=(weight (g) of the toner remaining on the sieve of the aperture size 45 μm)/4 (g)×100×0.2;

and

Flowability (%)=100−($a$+$b$+$c$).

(10) Shelf Stability

A container was provided with the toner for developing the electrostatic image, closed and sealed. Then, the container was submerged in a thermostatic water chamber at a temperature of 55° C. and for 8 hours, and then the container was taken out. The toner for developing the electrostatic image was taken out from the container onto a 42-mesh sieve carefully to avoid destruction of its structure minimally. This sieve was vibrated for 30 seconds with the use of the powder measuring device as in test (9), with the vibration intensity of 4.5. Then, the weight of the toner remaining on the sieve was measured, and the measured value was taken as the weight of the aggregated toner. The proportion of the weight (wt. %) of the aggregated toner to the weight of the toner initially placed in the container was calculated. The measurement was made three times for one sample, and the average of the measured values was obtained and used as an index of shelf stability. The shelf stability of the toner is better as it shows a smaller value (wt. %).

(11) Resolution:

A one-dot line, a one-dot white line, a two-dot line and a two-dot white line were printed using the above-mentioned commercially available printer. The printed images were observed with an optical microscope, and whether or not their image quality was reproduced was evaluated under the following criteria:

○: the one-dot line and the one-dot white line were reproduced;

Δ: none of the one-dot line and the one-dot white line were reproduced, but the two-dot line or the two-dot white line were reproduced; and X: none of the two-dot line or the two-dot white line were reproduced.

Example 1

A charge control resin composition was produced as below.

A charge control resin (100 parts; weight average molecular weight: 10,000, glass transition temperature: 65° C.), obtained by polymerizing 82 % of styrene, 11% of butyl acrylate and 7% of 2-acrylamide-2-methylpropanesufonic acid, was dispersed in 24 parts of toluene and 6 parts of methanol, and they were mixed by a roll with cooling. After the resulting mixture was winded on the roll, 100 parts of a cyan pigment (P.B. Pigment Blue 15:3, manufactured by Clariant Co., Ltd.) was gradually added, and they were agitated for 1 hour, to manufacture a charge control resin composition. During this period, the clearance between the rolls was initially 1 mm, broadened gradually, to finally to 3 mm, and an organic solvent (a solvent mixture of toluene/methanol=4/1) was added occationally according to mixing condition of the charge control resin composition. The organic solvent added was removed under reduced pressure after completion of mixing.

Separately, an aqueous solution containing 6.9 parts of sodium hydroxide (alkali metal hydroxide) dissolved in 50 parts of ion-exchanged water was gradually added to an aqueous solution containing 9.8 parts of magnesium chloride (water-soluble polyvalent metallic salt) dissolved in 250 parts of ion-exchanged water, with stirring, to prepare a magnesium hydroxide colloidal dispersion (colloid of slightly water-soluble metal hydroxide)

A polymerizable monomer composition for core comprising 82 parts of styrene and 18 parts of butyl acrylate, 12 parts of the above charge control resin composition, 3 parts of t-dodecylmercaptan, and 10 parts of dipentaerythritol tetramyristate, were mixed, stirred, and dispersed uniformly, to obtain a polymerizable monomer composition for core.

Separately, methyl methacrylate (2 parts; calculated Tg=105° C.) and 100 parts of water were subjected to finely-dispersing treatment using an ultrasonic emulsifier to obtain an aqueous dispersion of a polymerizable monomer for shell.

The above polymerizable monomer composition for core was poured into the above colloidal dispersion of magnesium hydroxide, and the mixture was stirred until droplets became stable. After stabilization of the droplets, 6 parts of t-butyl peroxy-2-ethylhexanoate (trade name: Perbutyl O, manufactured by NOF Corporation) was added. The resultant monomer mixture was stirred for 30 minutes at 15,000 rpm under high shearing force by means of Ebara Milder (trade name: MDN303V, manufactured by EBARA Corp.) to form finer droplets of the polymerizable monomer composition for core. The thus-prepared aqueous dispersion containing the droplets of the polymerizable monomer composition for core was provided into a reactor equipped with an agitating blade. The temperature of the dispersion began to be raised in the presence of oxygen, and polymerization was performed at the desired polymerization temperature of 90° C. At the time the conversion of the monomer into a polymer reached almost 100%, the above aqueous dispersion of the polymerizable monomer for shell and 0.2 part of 2,2'-azobis{2-methyl-N-(2-hydroxyethyl)-propionamide} (trade name: VA-086, manufactured by Wako Pure Chemical Industries, Ltd.) were added to the reactor. After the polymerization reaction was continued for 3 hours, the reaction was stopped, to obtain an aqueous dispersion of core-shell structure toner particles having a pH of 9.5.

While stirring the aqueous dispersion of core-shell structure toner particles obtained above, the pH of the system was adjusted to 5 or lower by adding sulfuric acid, and the dispersion was further washed for 10 minutes at 25° C. This dispersion was then dehydrated by filtration. Then, 500 parts of ion-exchanged water was added to form a slurry again and conduct washing with water. Then, the dehydration and water washing procedure was repeated several times. Thereafter, solid content was separated by filtration and dried with a dryer for 2 days and nights at 45° C., whereby toner particles were obtained.

To 100 parts of the toner particles obtained above, there was added 0.6 part of colloidal silica (RX-200, manufactured by Nihon Aerosil Co. Ltd.) subjected to a hydrophobicity-imparting treatment. They were mixed by means of a Henschel mixer to prepare a negatively charged toner for developing an electrostatic image. The thus obtained toner for developing the electrostatic image was evaluated in the above manner. The results are shown in Table 1.

Example 2

Toner particles were obtained in the same way as in Example 1, except for the following conditions: the aqueous dispersion containing the polymerizable monomer composition for core was provided into the reactor equipped with the agitating blade; then, with a nitrogen stream introduced into the reactor, the temperature was raised at a rate of 80° C./hr until a temperature reached 5° C. lower than the desired polymerization temperature, and was raised at a rate of 7° C./hr in a temperature region from the temperature was 5° C. lower than the desired polymerization temperature until it reached the desired polymerization temperature; after the temperature of the aqueous dispersion reached 90° C., polymerization was performed while introducing air into the gaseous phase of the reaction system.

The resulting toner particles were subjected to the same procedure as in Example 1, whereby a toner for developing an electrostatic image was obtained. The properties of the resulting toner, an image and so on were evaluated in the same manner as in Example 1. The results are shown in Table 1.

Example 3

Toner particles were obtained in the same way as in Example 1, except that a polymerizable monomer composition comprising of 85 parts of styrene, 15 parts of 2-ethylhexyl acrylate, and 0.5 part of divinylbenzene was used as the polymerizable monomer composition for core.

The resulting toner particles were subjected to the same procedure as in Example 1, whereby a toner for developing an electrostatic image was obtained. The properties of the resulting toner, an image and so on were evaluated in the same manner as in Example 1. The results are shown in Table 1.

Comparative Example 1

An aqueous solution containing 6.9 parts of sodium hydroxide dissolved in 50 parts of ion-exchanged water was gradually added to an aqueous solution containing 9.8 parts of magnesium chloride dissolved in 250 parts of ion-exchanged water, with stirring, to prepare a magnesium hydroxide colloidal dispersion.

A polymerizable monomer composition for core comprising of 80.5 parts of styrene and 19.5 parts of butyl acrylate, 12 parts of the above charge control resin composition, 3 parts of t-dodecylmercaptan, and 10 parts of pentaerythritol tetrastearate, were mixed, stirred, and dispersed uniformly, to obtain a polymerizable monomer composition for core.

Separately, methyl methacrylate (2 parts; calculated Tg=105° C.) and 100 parts of water were subjected to finely-dispersing treatment using an ultrasonic emulsifier to obtain an aqueous dispersion of a polymerizable monomer for shell.

The above polymerizable monomer composition for core was poured into the above colloidal dispersion of magnesium hydroxide, and the mixture was stirred until droplets became stable. After stabilization of the droplets, 6 parts of t-butyl peroxy-2-ethylhexanoate (trade name: Perbutyl O, manufactured by NOF Corporation) was added. The resultant monomer mixture was stirred for 30 minutes at 15,000 rpm under high shearing force by means of Ebara Milder (trade name: MDN303V, manufactured by EBARA Corp.) to form finer droplets of the polymerizable monomer composition for core. The thus-prepared aqueous dispersion containing the droplets of the polymerizable monomer composition for core was provided into a reactor equipped with an agitating blade. The temperature of the dispersion began to be raised in a nitrogen atmosphere, and polymerization was performed at the desired polymerization temperature of 90° C. At the time the conversion of the monomer into a polymer reached almost 100%, the above aqueous dispersion of the polymerizable monomer for shell and 0.2 part of VA-086 were added to the reactor. After the polymerization reaction was continued for 8 hours, the reaction was stopped, to obtain an aqueous dispersion of core-shell structure toner particles having a pH of 9.5.

While stirring the aqueous dispersion of core-shell structure polymerization toner particles obtained above, the pH of the system was adjusted to 5 or lower by adding sulfuric acid, and the dispersion was further washed for 10 minutes at 25° C. This dispersion was dehydrated by filtration. Then, 500 parts of ion-exchanged water was newly added to form a slurry again and conduct washing with water. Then, the dehydration and water washing procedure was repeated several times. Thereafter, solid content was separated by filtration and dried with a dryer for 2 days and nights at 45° C., whereby toner particles were obtained.

To 100 parts of the toner particles obtained above, there was added 0.6 part of colloidal silica (RX-200) subjected to a hydrophobicity-imparting treatment. They were mixed by means of a Henschel mixer to prepare a negatively charged toner for developing an electrostatic image. The thus obtained toner for developing the electrostatic image was evaluated in the same manner as in Example 1. The results of evaluation are shown in Table 2.

Comparative Example 2

0.1M aqueous solution of $Na_3PO_4$ and 1M aqueous solution of $CaCl_2$ were prepared. A mixer (trade name:TK Auto Homo Mixer, manufactured by TOKUSHU KIKA KOGYO Co. Ltd. was provided with 225 parts of 0.1M $Na_3PO_4$ and 355 parts of ion-exchanged water, and these were stirred at 12,000 rpm. The 1M aqueous solution of $CaCl_2$ (34 parts) was gradually added with stirring into the homomixer heated at 70° C. to prepare a colloidal dispersion of $Ca_3(PO_4)_2$, an aqueous medium.

Separately, 85 parts of styrene, 15 parts of 2-ethylhexyl acrylate, 5 parts of C.I. Pigment Blue 15:3, 2.5 parts of styrene-methacrylic acid-methyl methacrylate copolymer (Mw=50,000, Mw/Mn=2.5, acid value=50), 30 parts of paraffin wax (m.p. 70° C.), and 1.5 parts of a di-tert-butylsalicylic acid metal compound were prepared. Of these, only the C.I. Pigment Blue 15:3, di-tert-butylsalicylic acid metal compound and styrene were premixed using Ebara Milder (manufactured by EBARA Corp.). Then, the residual components of the above formulation were added and all ingredients were heated up to 60° C., dissolved and dispersed to form a monomer mixture. Further, with the mixture being held at 60° C., 5 parts of 2,2'- azobis-(2,4-dimethylvaleronitrile) and 0.5 part of dimethyl-2,2'-azobisisobutyrate were added and dissolved as polymerization initiators to prepare a polymerizable monomer system. This polymerizable monomer system was poured into the above-mentioned aqueous medium, and the mixture was stirred at 10,000 rpm for 20 minutes in an $N_2$ atmosphere (60° C.) with a TK Auto Homo Mixer to form suspension of droplets having a similar size with toner particles. Then, the suspension was reacted for 3 hours at 60° C. with toner stirring with a paddle agitating blade. The conversion into a polymer at this time was 90%. Then, the temperature of the suspension was raised up to 80° C., and stirring and polymerization reaction were continued further for 10 hours. After completion of the reaction, the suspension was cooled, and hydrochloric acid was added to dissolve $Ca_3(PO_4)_2$. Then, the system was filtered, washed with water, and dried to obtain toner particles.

Observation with an electron microscope showed that the surface of the toner particles had roughnesses, like cave-in and irregular shapes. Observation of sectional photo images of the toner particles, with a transmission electron microscope, using a stained ultra thin slice, showed that: the particles were constructed from a superficial portion mainly comprising of styrene-acrylic resin, and a central portion mainly comprising wax; and no island-shaped separate phase was present in a region near the surface, from the surface to a depth of 0.15 time of the particle diameter of the particle.

To 100 parts of the toner particles obtained above, there was added 0.6 part of colloidal silica (RX-200). The mixture was stirred by means of a Henschel mixer to prepare a negatively charged toner for developing the electrostatic image. The thus obtained toner for developing the electrostatic image was evaluated in the same manner as in Example 1. The results of evaluation are shown in Table 2.

TABLE 1

| Toner properties | Ex. 1 | Ex. 2 | Ex. 3 |
|---|---|---|---|
| Volume average particle diameter (Dv, μm) | 7.5 | 7.5 | 7.5 |
| Particle diameter distribution (Dv/Dp) | 1.2 | 1.2 | 1.2 |
| Average circle degree | 0.97 | 0.97 | 0.97 |
| Location parameter of island-shaped separate phase (number %) | 30 | 49 | 55 |
| THF-extractable component content (wt. %) | 70 | 67 | 36 |
| Acid value (mg KOH/g) | 2.5 | 2.4 | 2.5 |
| Base value (mg HCl/g) | 0.3 | 0.3 | 0.2 |
| Image quality characteristics | | | |
| Toner fixing temperature (° C.) | 125 | 120 | 120 |
| Hot offset resistance (° C.) | 190 | 200 | 205 |
| Flowability (%) | 75 | 70 | 75 |
| Shelf stability (wt %) | 6 | 4 | 3 |
| Resolution (600 dpi) | ○ | ○ | ○ |

TABLE 2

| Toner properties | Comp. Ex. 1 | Comp. Ex. 2 |
|---|---|---|
| Volume average particle diameter (Dv, μm) | 7.7 | 7.8 |
| Particle diameter distribution (Dv/Dp) | 1.3 | 1.3 |
| Average circle degree | 0.98 | 0.95 |
| Location parameter of island-shaped separate phase (number %) | 21 | 0 |
| THF-extractable component content (wt. %) | 48 | 75 |
| Acid value (mg KOH/g) | 2.9 | 5.1 |
| Base value (mg HCl/g) | 0.3 | 0.3 |
| Image quality characteristics | | |
| Toner fixing temperature (° C.) | 130 | 140 |
| Hot offset resistance (° C.) | 175 | 160 |
| Flowability (%) | 40 | 30 |
| Shelf stability (wt %) | 20 | 50 |
| Resolution (600 dpi) | Δ | X |

The results of evaluation of the toners for developing the electrostatic image in Tables 1 and 2 show the following facts:

The toners for developing an electrostatic image in Comparative Examples 1 and 2, in which the location parameters of island-shaped separate phase are smaller than the ranges defined by the present invention, are unsatisfactory in hot offset resistance, flowability, shelf stability, and resolution.

The toners for developing the electrostatic image in Examples 1 and 2 of the present invention, on the other hand, are satisfactory in hot offset resistance, flowability, shelf stability, and resolution.

INDUSTRIAL APPLICABILITY

As noted above, the present invention provides a toner for developing an electrostatic image which is excellent in hot offset resistance, flowability, shelf stability, and resolution. The toner is useful for electro photography devices such as printers and copiers.

What is claimed is:

1. A toner for developing an electrostatic image, said toner containing toner particles comprising:

a binder resin, a colorant, a charge control agent, a parting agent, wherein:

a volume average particle diameter (Dv) of said toner particles is 3 to 10 Φm;

a ratio (Dv/Dp) of said volume average particle diameter (Dv) to a number average particle diameter (Dp) of said toner particles is 1 to 1.3;

an average circle degree of said toner particles is 0.93 to 0.995; and a location parameter of island-shaped separate phase is 25 number % or more, wherein the location parameter is the percentage of such sectional photo images of toner particles where a maximum diameter of island-shaped separate phase is 1 Φm or more and an outermost portion of said island-shaped separate phase is present at the depth of 0.01 to 0.15 times the particle diameter of each toner particle under the surface of said toner particle, among sectional photo images of said toner particles having an island-shaped separate phase and a particle diameter in the range of 0.6 to 1.2 times said volume average particle diameter being formed by photographing with an electron microscope;

a tetrahydrofuran-extractable component content of said toner is from 10 to 80% by weight;

an acid value from 5 mg KOH/g or less; and an amine value from 3.25 mg HCl/g or less.

2. The toner for developing the electrostatic image according to claim 1, wherein the location parameter of island-shaped separate phase is 35 number % or more.

3. The toner for developing the electrostatic image according to claim 1, wherein the location parameter of island-shaped separate phase is 45 number % or more.

4. The toner for developing the electrostatic image according to claim 1, which is negatively charge-able.

5. The toner for developing the electrostatic image according to claim 1, which has a tetrahydrofuran-extractable component content of 10 to 80% by weight.

6. The toner for developing the electrostatic image according to claim 1, which has a core-shell structure.

7. The toner for developing the electrostatic image according to claim 1, which has an acid value of 5 mg KOH/g or less.

8. The toner for developing the electrostatic image according to claim 1, which has an acid value of 3 mg KOH/g or less.

9. The toner for developing the electrostatic image according to claim 1, which has an amine value of 3.25 mg HCl/g or less.

10. The toner for developing the electrostatic image according to claim 1, which has an amine value of 3 mg HCl/g or less.

11. The toner for developing the electrostatic image according to claim 1, which has an average circle degree of 0.95 to 0.995.

12. The toner for developing the electrostatic image according to claim 1, which has an average circle degree of 0.96 to 0.995.

13. The toner for developing the electrostatic image according to claim 1, wherein said parting agent is a polyfunctional ester compound.

14. The toner for developing the electrostatic image according to claim 1, wherein said charge control agent is a charge control resin having a weight average molecular weight of 2,000 to 50,000.

15. The toner for developing the electrostatic image according to claim 1, wherein said binder resin is selected from a group consisting of polystyrene, styrene-butyl acrylate copolymer, polyester resin, and epoxy resin.

16. The toner for developing the electrostatic image according to claim 1, wherein said charge control agent is a polymer whose side chain has a sulfonic acid group or a salt thereof.

17. The toner for developing the electrostatic image according to claim 1, wherein said colorant is a copper phthalocyanine compound or a derivative thereof.

18. The toner for developing the electrostatic image according to claim 1, further comprising an external additive.

* * * * *